US007371284B2

(12) United States Patent
Nagami

(10) Patent No.: US 7,371,284 B2
(45) Date of Patent: May 13, 2008

(54) POWDER COATING APPARATUS AND METHOD OF MANUFACTURING STATOR OF ROTARY ELECTRIC MACHINE

(75) Inventor: Yukihisa Nagami, Anjo (JP)

(73) Assignee: Denso Corporation, Kariya (JP)

( * ) Notice: Subject to any disclaimer, the term of this patent is extended or adjusted under 35 U.S.C. 154(b) by 469 days.

(21) Appl. No.: 10/978,410

(22) Filed: Nov. 2, 2004

(65) Prior Publication Data

US 2005/0123679 A1 Jun. 9, 2005

(30) Foreign Application Priority Data

Nov. 7, 2003 (JP) ..... 2003-378404

(51) Int. Cl.
*B05C 19/00* (2006.01)
*B05C 13/02* (2006.01)
*B05B 15/04* (2006.01)

(52) U.S. Cl. ..... 118/308; 118/505; 118/DIG. 11; 118/320

(58) Field of Classification Search ..... 118/308, 118/309, 306, 317, 504–505, 58–62, 307, 118/DIG. 11, 318, 320, 326; 427/195, 181, 427/235, 239

See application file for complete search history.

(56) References Cited

U.S. PATENT DOCUMENTS 3,355,309 A * 11/1967 Bender et al. ..... 427/104
4,411,935 A * 10/1983 Anderson ..... 427/446
6,719,847 B2 * 4/2004 Rice et al. ..... 118/504

FOREIGN PATENT DOCUMENTS

JP 2000-153218 6/2000

* cited by examiner

*Primary Examiner*—Yewebdar Tadesse
(74) *Attorney, Agent, or Firm*—Oliff & Berridge, PLC

(57) ABSTRACT

A powder coating apparatus 100 and a method of manufacturing a stator 200 are disclosed wherein the stator is set in masking caps 110, 120 such that axial end faces of the stator are masked by the masking caps, respectively, so as to define a first clearance in an area closer to a powder spray nozzle 160 and a second clearance in the other area remote from the powder spray nozzle. The first clearance closer to the powder spray nozzle 160 is set to have airflow resistance less than that of the second clearance remote from the powder spray nozzle for thereby permitting compressed air, delivered from a compressed air supply unit 150, to be discharged through the first clearance at an increased flow rate.

6 Claims, 4 Drawing Sheets

POWDER COATING APPARATUS AND METHOD OF MANUFACTURING STATOR OF ROTARY ELECTRIC MACHINE

CROSS REFERENCE TO RELATED APPLICATIONS

This application is related to Japanese Patent Application No. 2003-378404 filed on Nov. 7, 2003, the content of which is hereby incorporated by reference.

BACKGROUND OF THE INVENTION

1. Field of the Invention

The present invention relates to powder coating apparatuses and methods of applying coating powder onto an object to be coated and, more particularly, to a powder coating apparatus for applying a coating of resin powder, such as epoxy resin, onto an outer periphery of a stator of a rotary electric machine and a method of manufacturing a stator of a rotary electric machine.

2. Description of the Related Art

In the related art, attempts have heretofore been made to provide a powder coating method wherein a voltage is imparted to an object to be coated, such as a stator or rotor of a rotary electric machine, and resin powder is sprayed onto the outer periphery of the object and then thermally set to provide an insulation coating (see Japanese Patent Provisional Publication No. 2000-153218 (on pages 3 and 4 and in FIGS. 1 to 7).

By the way, during powder coating, the areas of the object, which are not to be coated, are protected by mechanical masking as proposed in the above-described related art. In such cases, it is probable for a slight clearance to occur between a masking member and an area which is not coated on the object due to a distortion in the shape of the object to be coated, resulting in the issue of being difficult to reliably achieve the powder coating only on a desired area.

SUMMARY OF THE INVENTION

The present invention has been completed with the above view in mind and has an object to provide a powder coating apparatus and a method of manufacturing a stator of a rotary electric machine which are able to prevent the occurrence of masking defects to allow favorable powder coating to be made only on a desired area of the object to be coated.

To achieve the above object, one aspect of the present invention provides a powder coating apparatus which comprises a rotating and holding mechanism for rotatably holding an object to be coated in a form of a centrically shape, and a powder spray nozzle for spraying resin powder toward a coating area of the object to be coated. A mask member is for masking a non-coating area of the object so as to define a first clearance and a second clearance, each between the mask member and the non-coating area, in such a way that the first clearance has an airflow resistance lower than that of the second clearance. A compressed air supply unit is connected to the mask member to discharge compressed air through the first and second clearances toward a space in which the powder spray nozzle.

With such a structure, due to the presence of the first clearance, with low airflow resistance, in the area closer to the powder spray nozzle, a stream of compressed air can be reliably discharged through the first clearance to avoid resin powder, emitting from the powder spray nozzle, from penetrating the first clearance. As a consequence, even in the presence of slight distortion in the shape of the object to be coated, masking defects can be avoided, making it possible to reliably achieve favorable powder coating only on a desired area of the object to be coated.

With the structure set forth above, a length of a path through which the compressed air is discharged through the first clearance may be preferably set to a value less than a length of another path through which the compressed air is discharged through the second clearance. This results in a capability of reliably minimizing airflow resistance of the first clearance in the area closer to the powder spray nozzle.

Further, the mask member may have a rotation symmetric profile and the object to be coated may have a cylindrical shape. Under such conditions, a central axis of the mask member is displaced from a central axis of the object to be coated to be eccentric toward the powder spray nozzle. This enables a layout of the mask member to be merely contrived for thereby achieving reduction in airflow resistance in the area closer to the powder spray nozzle in an easy and reliable manner.

Furthermore, the first clearance may preferably include a gap greater than that of the second clearance. This enables reduction in airflow resistance of the first clearance in the area closer to the powder spray nozzle in a reliable manner.

Moreover, the powder coating apparatus may preferably include a mask member rotating mechanism for rotating the mask member. This results in a capability of preventing the occurrence of localized irregularities in the amount of resin powder, emitting from the powder spray nozzle, to be adhered onto an outer periphery of the mask member, thereby increasing a length of time required for cleaning to be performed when the amount of adhesion exceeds an allowable value for reduction in labor hours for maintenance.

In addition, the powder coating apparatus may further include a powder resin removing mechanism for removing the powder resin from the mask member. This enables the mask member to be rotated for removing resin powder from the outer periphery of the mask member, making it possible to further reduce labor hours for maintenance.

According to another aspect of the present invention, there is provided a powder coating apparatus, which comprises a rotating mechanism which rotates an object, a powder spray nozzle which sprays a resin powder to coat a first area of the object being rotated by the rotating mechanism with the resin powder, and an air compressor working to supply air. A mask member masks a second area of the object through a gap, the gap defining a flow path between the mask member and the second area of the object which leads to the air compressor, the flow path including a first section and a second section, the first section being designed to direct and discharge a flow of the air supplied from the air compressor outside the flow path in a first direction in which the flow of the air is oriented against a spray of the resin powder outputted from the powder nozzle, the second section being designed to direct a flow of the air supplied from the air compressor in a second direction different from the first direction, the first section having a flow resistance smaller than that of the second direction.

According to another aspect of the present invention, there is provided a method of manufacturing a stator of a rotary electric machine. The method comprises providing a powder spray nozzle, and providing a mask member. A stator, serving as a cylindrical object to be coated, is located in a set position associated with the mask member such that the mask member masks a non-coating area of the stator and allows a coating area of the stator to be exposed to the powder spray nozzle. The stator is rotated while the same is located in the set position. A resin powder is sprayed toward an outer periphery of the stator, and the stator is removed from the set position, whereupon a whole of the stator is heated to thermally set the resin powder on the stator.

BRIEF DESCRIPTION OF THE DRAWINGS

For a better understanding of the present invention and to show how the same may be carried into effect, there will now be described by way of example only, specific embodiments according to the present invention with reference to the accompanying drawings, in which.

DETAILED DESCRIPTION OF THE PREFERRED EMBODIMENTS

Hereinafter, powder coating apparatuses of various embodiments, to which the present invention is applied, will be described below in detail with reference to the accompanying drawings.

First Embodiment

Figure 1:
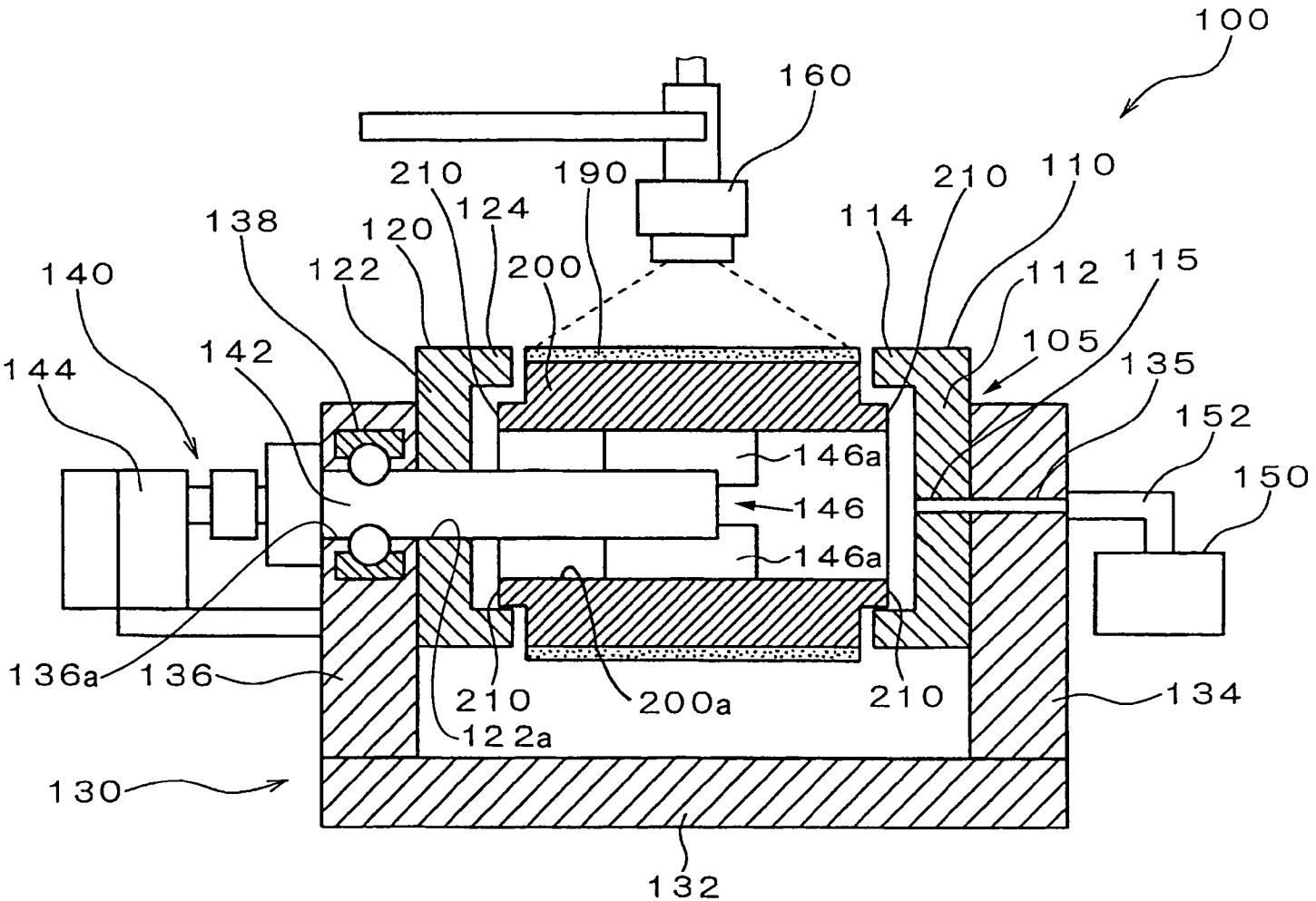
FIG. 1 is a view illustrating a cross sectional structure of a powder coating apparatus of a first embodiment according to the present invention to carry out a stator manufacturing method of the present invention.

FIG. 1 is a view illustrating a cross sectional structure of a powder coating apparatus of a first embodiment according to the present invention. The powder coating apparatus 100, shown in FIG. 1, is of a type that uniformly sprays resin powder 190 over an outer circumferential periphery of a stator 200 of a rotary electric machine and comprised of masking caps 110, 120 axially spaced from one another, a masking base 130 that supports upright mounting sections 134, 136 with which the masking caps 110, 120 are fixedly carried, a work piece rotating mechanism 140, a compressed air supply unit 150 and a powder spray nozzle 160.

The stator 200 serves as a cylindrical object to be coated and forms a component part of a vehicular electric power generator (alternator). Thus, the stator 200 has an outer peripheral surface that is applied with a powder coating to effectively protect the stator 200 against corrosion or to resist deteriorations from weathering and exposure. Further, the stator 200 has a winding with both ends axially protruding and during powder coating, axial end faces of the winding on an outer periphery thereof are masked to preclude adhesion of resin powder 190. Also, the stator 200 is typically described in FIG. 1 and includes axial protrusions 210, extending from axial end faces (on left and right end faces) of the stator 200 at a position closer to a central axis of the stator, which are indicative of a winding portion. Examples of resin powder 190 generally include thermosetting resin materials such as epoxy resin family, acryl resin family and polyester resin family.

The masking cap 110 serves as a mask member, by which one of the axial end faces of the stator 200 is covered to shield a non coating area of the outer periphery of the winding, and has a rotation symmetric configuration with a C-shape in cross section. More particularly, the masking cap 110 is comprised of a circular disc portion 112 whose outer diameter is substantially equal to an outer diameter of the stator 200, and a cylindrical portion 114 axially extending from the circular disc portion 112 to surround an outer periphery in the vicinity of one of the axial end faces of the stator 200. A distal end (opposite to the circular disc portion 112) of the cylindrical portion 114 takes a form of a flat surface for masking an associated end face of the stator 200. During powder coating operation of the stator 200, the masking cap 110 is positioned such that a clearance between the end face of the cylindrical portion 114 of the masking cap 110 and the associated axial end face of the stator 200 lies in a given value (for instance, in the order of approximately 0.2 mm). Also, the masking cap 110 is set to an eccentric position eccentric toward the powder spray nozzle 160 to provide a given distance between a central axis of the circular disc portion 112 and the central axis of the stator 200. Moreover, formed in the circular disc portion 112 at a given position (for instance, in the vicinity of a central axis of the circular disc portion 112) is a through-bore 115 for supplying an internal space (a space surrounded by an inner periphery) of the stator 200 with compressed air from an outside of the circular disc portion 112.

Likewise, the masking cap 120 serves as a mask member that fundamentally has the same configuration as the masking cap 110 except for the through-bore 115 and lies in the same locating position as the masking cap 110. Also, the masking cap 120 includes a circular disc portion 122 that has a central bore 122*a* through which a rotary shaft 142 of the work piece rotating mechanism 140 extends. The rotary shaft 142 has a central axis concentrically aligned with the central axis of the stator 200, and the central bore 122*a* of the circular disc portion 122 is formed in an area displaced downward from a circular center of the circular disc portion 122 with respect to the powder spray nozzle 160.

The masking base 130 serves as a member to support the masking caps 110, 120 and the work piece rotating mechanism 140 and includes a pedestal 132 formed of a horizontally flat-shaped plate member, and two mounting sections 134, 136 composed of plate members vertically mounted on the pedestal 132 in parallel at positions spaced from one another by a given distance. Fixedly secured onto an end face of the mounting section 134 is the masking cap 110 whose circular disc portion 112 is held in contact with the associated end face of the mounting section 134. Also, the mounting section 134 has a given area formed with a through-bore 135 that is connected through a supply conduit 152 to the compressed air supply unit 150 to supply compressed air to the internal space of the stator 200. To this end, the through-bore 135 is formed in the mounting section 134 at the same position as the through-bore 115, formed in the masking cap 110, to provide fluid communication therebetween when the masking cap 110 is mounted onto the mounting section 134, with these two through-bores 115, 135 integrally forming a compressed air supply passage. Fixedly fastened to an end face of the other mounting section 136 is the other masking cap 120 whose circular disc portion 122 is held in contact with the associated end face of the mounting section 136. The mounting section 136 is formed with a through-bore 136*a* through which the rotary shaft 142 of the work piece rotating mechanism 140 extends, and a bearing 138 is mounted to the through-bore 136*a* to rotatably support the rotary shaft 142.

The work piece rotating mechanism 140 serves as a rotating and holding mechanism that rotatably supports the stator 200. In order to rotate the stator 200 at a fixed speed, the work piece rotating mechanism 140 is comprised of the rotary shaft 142, a drive motor 144 and a work piece fixture member 146. As set forth above, the rotary shaft 142 extends through the through-bore 136*a* of the mounting section 136 and the central bore 122*a* of the masking cap 120 and has one end connected to the drive motor 144 and the other end to which the work piece fixture member 146 is mounted. The drive motor 144 rotates the rotary shaft 142 at the fixed speed in a given direction. The work piece fixture member 146 is comprised of a plurality of (for instance, four pieces of) plate members 146*a* that are moveable inward in a radial direction to allow the plate members 146*a* to be guided through an inner periphery 200*a* of the stator 200 and moveable outward in the radial direction to cause the plate members 146*a* to be held in pressured contact with the inner periphery 200*a* of the stator 200 to hold the stator 200.

As previously noted above, the compressed air supply unit 150 is connected to the through-bore 135 of the mounting section 134 of the masking base 130 through the supply conduit 152 and supplies compressed air into the internal space of the stator 200 through the supply passage formed by the through-bores 115, 135.

The powder spray nozzle 160 is supplied with compressed air and resin powder 190 from respective supply units (not shown) and injecting compressed air from a nozzle end simultaneously allows resin powder 190 to be sprayed onto a coating area of the outer circumferential periphery of the stator 200. Powder and air volume are independently controlled and dilution ratios can be adjusted to obtain a desired thickness coverage needed to meet specific product requirements.

Also, the powder spray nozzle 160 is electrically connected to an output terminal of a power supply unit (not shown) and applied with a voltage in a polarity opposite to the voltage applied to the stator 200 such that resin powder 190, emitting from the powder spray nozzle 160, is brought into a positively or negatively charged state. For instance, the powder spray nozzle 160 is applied with a positive voltage and the stator 200 is electrically connected to the ground via the work piece fixing section 146 and the rotary shaft 142.

In operation, the powder coating apparatus 100 of the presently filed embodiment has features described below. That is, locating the masking caps 110, 120 at positions eccentric from the stator 200 permits airflow resistance, occurring in a first clearance between each end face of the masking caps 110, 120 and the associated axial end face of the stator 200 in an area closer to the powder spray nozzle 160, to be less than that of a second clearance between each end face of the masking caps 110, 120 and the associated axial end face of the stator 200 in the other area remote from the powder spray nozzle 160.

Figure 2:
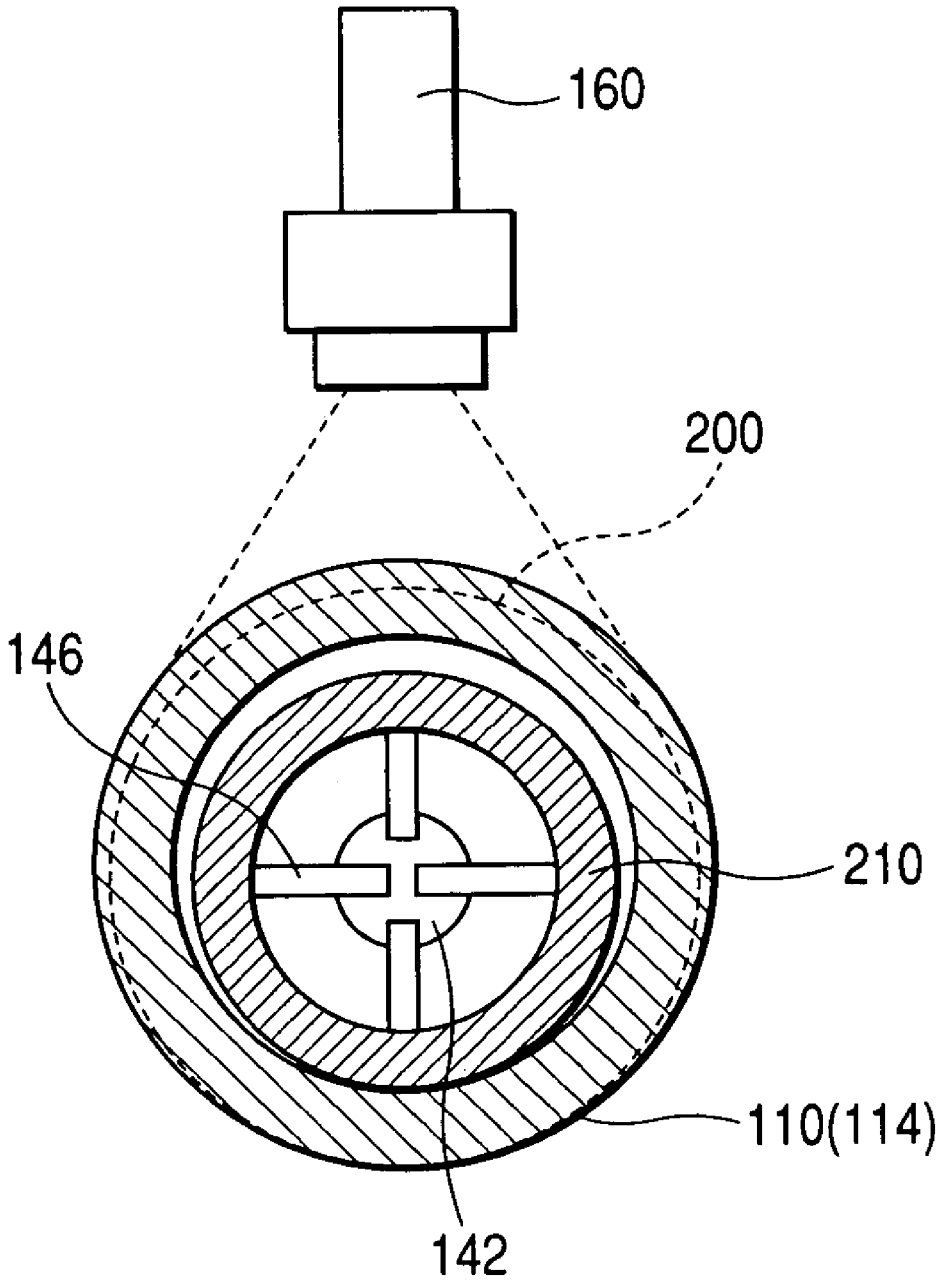
FIG. 2 is a view illustrating a positional relationship between a masking cap and an axial end face of a stator.

FIG. 2 is a cross sectional view illustrating a positional relationship between the axial end face of the masking cap 110 and the associated end face of the stator 200. Also, the axial end faces of the masking cap 120 and the associated end face of the stator 200 lies in the same positional relationship as that between the axial end faces of the masking cap 110 and the stator 200 and, therefore, description will be made of the operation focusing only on the masking cap 110.

With the structure of the presently filed embodiment, an outer diameter of the cylindrical portion 114 of the masking cap 110 is set to be greater than that of the stator 200. For this reason, with the stator 200 set in the powder coating apparatus 100, a clearance between the axial end faces of the cylindrical section 114 and the stator 200 varies such that it has a small radial length in an area closer to the powder spray nozzle 160 and has a large radial length in the other area remote from the powder spray nozzle 160 as shown in FIG. 2. Also, a distance in a radial direction between the axial protrusion 210 of the stator 200 and the cylindrical portion 114 of the masking cap 110 is wide in an area closer to the powder spray nozzle 160 and narrow in the other area remote from the powder spray nozzle 160. Accordingly, if a distance between the associated axial end faces of the cylindrical portion 114 of the masking cap 110 and the stator 200 lies in a fixed value over an entire circumference, airflow resistance in the clearance, through which the internal space of the stator 200 and the outside space are held in fluid communication, is low in the area closer to the powder spray nozzle 160 and high in the other area remote from the powder spray nozzle 160.

Therefore, if compressed air under a given pressure is supplied into the internal space of the stator 200 from the compressed air supply unit 150, a compressed air stream is discharged through the clearance between the axial end faces of the masking cap 110 and the stator 200 in the area closer to the powder spray nozzle 160 at a greater flow rate than that discharged through the clearance in the other area remote from the powder spray nozzle 160. With such a feature, even if resin powder 190, emitting from the powder spray nozzle 160 and reaching the outer circumferential periphery of the stator 200, tends to penetrate an area near the axial end face of the stator 200 in the presence of slight distortion in the shape of the stator 200, compressed air discharged through the associated clearance in the area closer to the powder spray nozzle 160 at a given flow rate interrupts the entry of resin powder 190, resulting in a capability of precluding resin powder 190 from adhesion onto the axial end face of the stator 200.

In such a way, permitting the work piece rotating mechanism 140 to rotate the stator 200 one turn at a given speed while injecting resin powder 190 from the powder nozzle 160 enables resin powder 190 to be coated onto only the outer periphery of the stator 200 in a nearly uniform manner. Also, the rotational speed of the stator 200 driven by the work piece rotating mechanism 140 is determined depending on the amount of resin powder 190 to be injected from the powder spray nozzle 160 and a film thickness of resin powder 190 to be applied onto the outer peripheral surface of the stator 200. Moreover, the stator 200 may be rotated not only one turn but also several turns.

Thus, with the structure wherein the masking caps 110, 120 are for masking the stator 200, serving as an object to be coated, to allow the clearance between the axial end faces of the stator 200 and the associated one of the masking caps 110, 120 in the area closer to the powder spray nozzle 160 to have low airflow resistance, the compressed air stream can be reliably discharged through the clearance adjacent to the non coating area of the object at an increased flow rate, thereby enabling resin powder 190 from being prevented from penetrating the non coating area of the stator 200. Thus, no masking defects occur, making it possible to perform favorable powder coating only for a desired coating area of the stator 200.

Further, with a length of a path in the clearance between the axial end faces of the stator 200 and the associated masking cap in the area closer to the powder spray nozzle 160 set to be shorter than that of a path in the clearance between the axial end faces of the stator 200 and the associated masking cap at the other area remote from the powder spray nozzle 160, airflow resistance of the clearance in the area closer to the powder spray nozzle 160 can be reliably minimized.

Furthermore, with both the stator 200 and the masking caps 110, 120 having rotation symmetric profiles, the central axes of the masking caps 110, 120 are made eccentric from the central axis of the stator 200 to be closer to the powder spray nozzle 160. Thus, merely contriving layouts of the masking caps 110, 120 enables reduction in airflow resistance of the clearance in the area closer to the powder spray nozzle 160 in an easy and reliable manner.

A method of manufacturing the stator 200 using the powder coating apparatus 100 of the presently filed embodiment is carried out in a process described below.

(1) The stator 200 with the winding is located in a set position such that the masking caps 110, 120 mask both the axial end faces of the stator 200, respectively.

(2) The stator 200 is rotated by the work piece rotating mechanism 140 with the stator 200 being held in the set position by the work piece fixing section 146. At the same time, resin powder 190 is injected from the powder spray nozzle 160 onto the outer circumferential periphery of the stator 200 during rotation thereof.

(3) After removing the stator 200 from the set position, the stator 200 is put in a constant-temperature bath whose temperature is raised to allow the stator 200 to be left in the bath for a given time interval at a fixed temperature, thereby causing resin powder 190, adhered onto the outer circumferential periphery of the stator 200, to be thermally set.

This enables resin powder to be prevented from adhesion onto both the axial end faces (non coating areas) of the stator 200 in an easy and reliable manner when performing powder coating onto the outer circumferential periphery of the stator 200.

Second Embodiment

Figure 3:
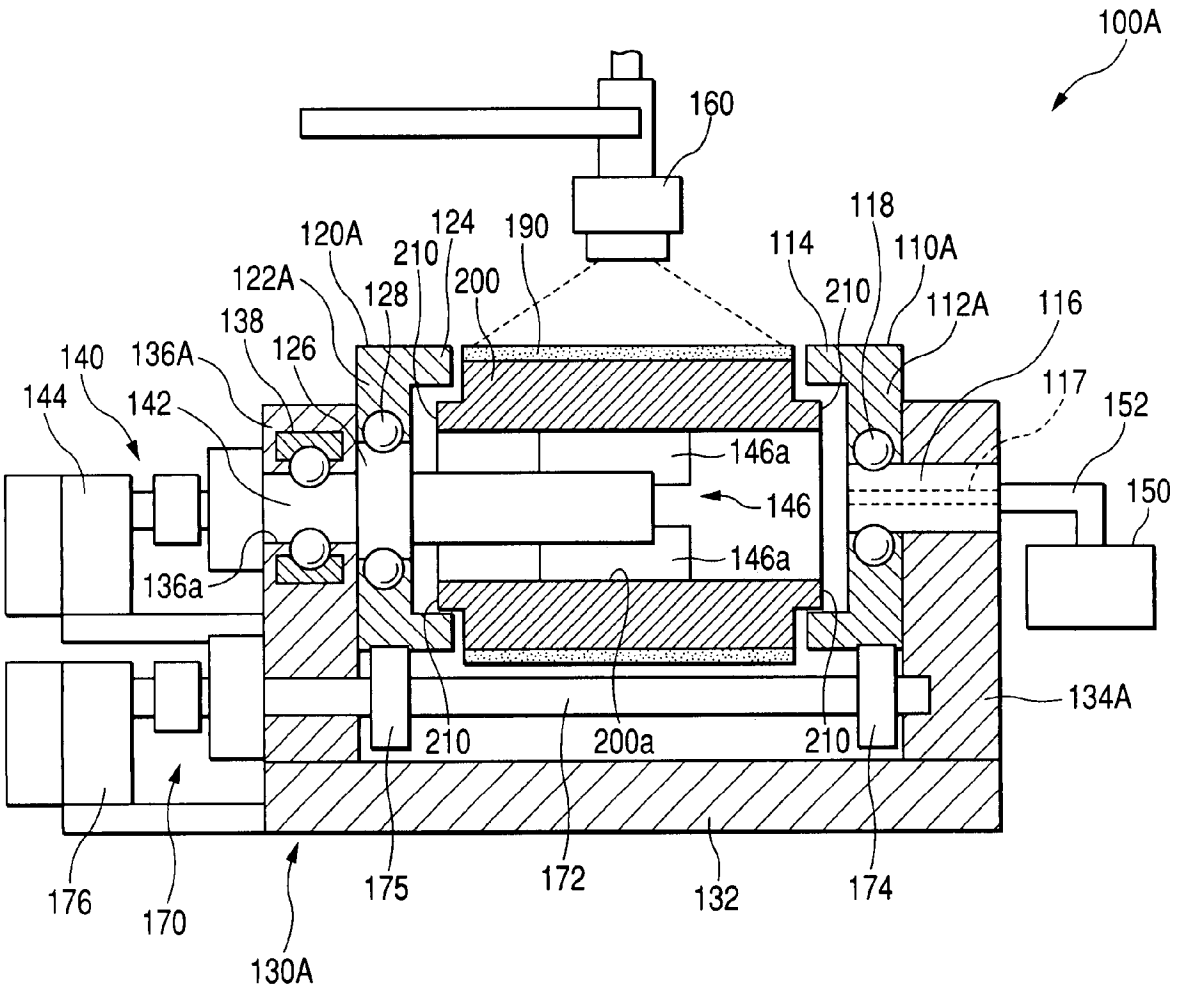
FIG. 3 is a view illustrating a cross sectional structure of a powder coating apparatus of a second embodiment according to the present invention.

FIG. 3 is a view illustrating a cross sectional structure of a powder coating apparatus of a second embodiment according to the present invention. The powder coating apparatus 100A shown in FIG. 3 is comprised of masking caps 110A, 120A, a masking base 130A, the work piece rotating mechanism 140, the compressed air supply unit 150, the powder spray nozzle 160, and a masking cap rotating mechanism 170. The same component parts as those of the powder coating apparatus 100 shown in FIG. 1 bear like reference numerals to omit or simplify detailed description. Also, the component parts, which are different in shape or function but have correspondences, bear like reference numerals with an affix of "A" for description of the component parts.

Hereinafter, description is made of the powder coating apparatus 100A of the presently filed embodiment focusing on differences between the two embodiments.

The masking caps 110A, 120A differ from the masking caps 110, 120 of the first embodiment shown in FIG. 1 in that the masking caps 110A, 120A are rotatably supported. A mounting section 134A stands upright from a masking base 130A and carries a stationary shaft 116 that axially extends. One end of the stationary shaft 116 protrudes from an end face of the mounting section 134A toward a setting position of the stator 200 to rotatably support the masking cap 110A by means of a bearing 118. Also, the stationary shaft 116 is formed with a through-bore 117 extending in an axial direction. The through-bore 117 corresponds to the supply passage composed of the through-bores 115, 135 shown in FIG. 1 and is connected through the supply conduit 152 to the compressed air supply unit 150 to introduce compressed air into the internal space of the stator 200.

Further, a fixing member 126 is mounted on an outer periphery of the rotary shaft 142 of the work piece rotating mechanism 140 at a position close proximity to a central axis of the masking cap 120A. The masking cap 120A is rotatably mounted on the fixing member 126 by means of a bearing 128. Mounting the masking cap 120A on the outer periphery of the rotary shaft 142 by means of the fixing member 126 and the bearing 128 allows the masking cap 120A to be rotated regardless of a direction in which the rotary shaft 142 is rotated.

The masking cap rotating mechanism 170 takes the form of a mask member rotating mechanism that rotates the masking caps 110A, 120A and is comprised of a rotary shaft 172, rollers 174, 175 and a drive motor 176. The roller 174 is held in pressured contact with an outer periphery of the masking cap 110A and rotating the rotary shaft 172 allows the masking cap 110A to be rotated in one direction by means of the roller 174 held in pressured contact therewith. Likewise, the roller 175 is held in pressured contact with an outer periphery of the masking cap 120A and rotating the rotary shaft 172 allows the masking cap 120A to be rotated in one direction by means of the roller 175 held in pressured contact therewith. The drive motor 176 rotates the rotary shaft 172 at a fixed speed in a given direction.

With such a structure of the powder coating apparatus 100A of the presently filed embodiment, the masking cap rotating mechanism 170 rotates the masking caps 110A, 120A when performing powder coating onto the outer periphery of the stator 200.

With the powder coating apparatus 100 shown in FIG. 1, the two masking caps 110, 120 are fixedly secured to the masking base 130 and the mounting sections 134, 136. In such a case, resin powder 190, emitting from the powder spray nozzle 160, is caused to adhere mainly onto the outer periphery of the stator 200 and partially dispersed in other areas. While the powder coating apparatus 100 is arranged such that in order to prevent dispersed powder resin 190 from adhering onto the axial end faces of the stator 200, airflow resistances in the clearances between the axial end faces of the associated component parts in the areas closer to the powder spray nozzle 160 are made low to preclude resin powder 190 from penetrating the non coating areas of the stator 200. However, it is hard for resin powder 190 to be prevented from adhering onto the masking caps 110, 120 located outside the clearances. Accordingly, a need arises for resin powder 190, adhered onto the outermost areas of the masking caps 110, 120, to be cleaned and removed therefrom before the amounts of resin powder 190 adhered onto the masking caps 110, 120 exceeds an allowable value (above which for instance, resin powder 190 adhered onto the masking caps 110, 120 partially drops off therefrom into the clearances in the vicinities of the axial end faces of the stator 200 due to vibrations caused by the rotation of the rotary shaft 142).

On the contrary, with the powder coating apparatus 100A of the presently filed embodiment, the masking cap rotating mechanism 170 is operative to rotate the masking caps 110A, 120A during a time interval in which the powder spray nozzle 160 injects resin powder 190 onto the outer periphery of the stator 200, causing resin powder 190 to be uniformly adhered onto entire outer peripheral surfaces of the masking caps 110A, 120A. Accordingly, it is possible to extend a length of time in which resin powder 190 adheres onto the outer peripheries of the masking caps 110A, 120A until a part of resin powder 190 adhered onto the outer peripheries of the masking caps 110A, 120A drop off into the clearances in the vicinities of the axial end faces of the stator 200. Thus, it becomes possible to extend a time interval required for cleaning resin powder 190 for removal from the outer peripheries of the masking caps 110A, 120A, enabling reduction in labor work for maintenance.

Also, the present invention is not limited to the particular embodiments discussed above and a variety of alterations or modifications may be carried out within a scope of teachings of the present invention. While the present invention has been described with reference to the particular embodiments described above where resin powder 190 is coated over the outer periphery of the stator 200 of the vehicular electric power generator, the powder coating may be applied to other cylindrical objects than the stator 200. For instance, the powder coating method of the present invention may be applied to outer peripheries of stators for vehicular start-up devices (such as starters) and rotary electric machines for use in other applications than vehicles or cylindrical members, such as stators or rotors, of other devices.

Further, while the above embodiments have been set forth above with reference to a structure where resin powder 190 is sprayed toward the outer periphery of the stator 200 using a single piece of powder spray nozzle 160, the number of powder spray nozzles to be used may be increased depending on shapes of objects to be coated. Also, it may be preferable for the amount of eccentric displacement between the central axis of the masking cap and the central axis of the stator to be suitably determined depending on shapes of the objects to be coated and the masking caps.

Furthermore, although the above embodiments have been described in connection with a structure where the object to be coated (stator 200) is fixed in place by restraining the inner periphery, other areas (such as end faces) of the object to be coated may be restrained depending on the shape of the object to be coated.

Figure 4:
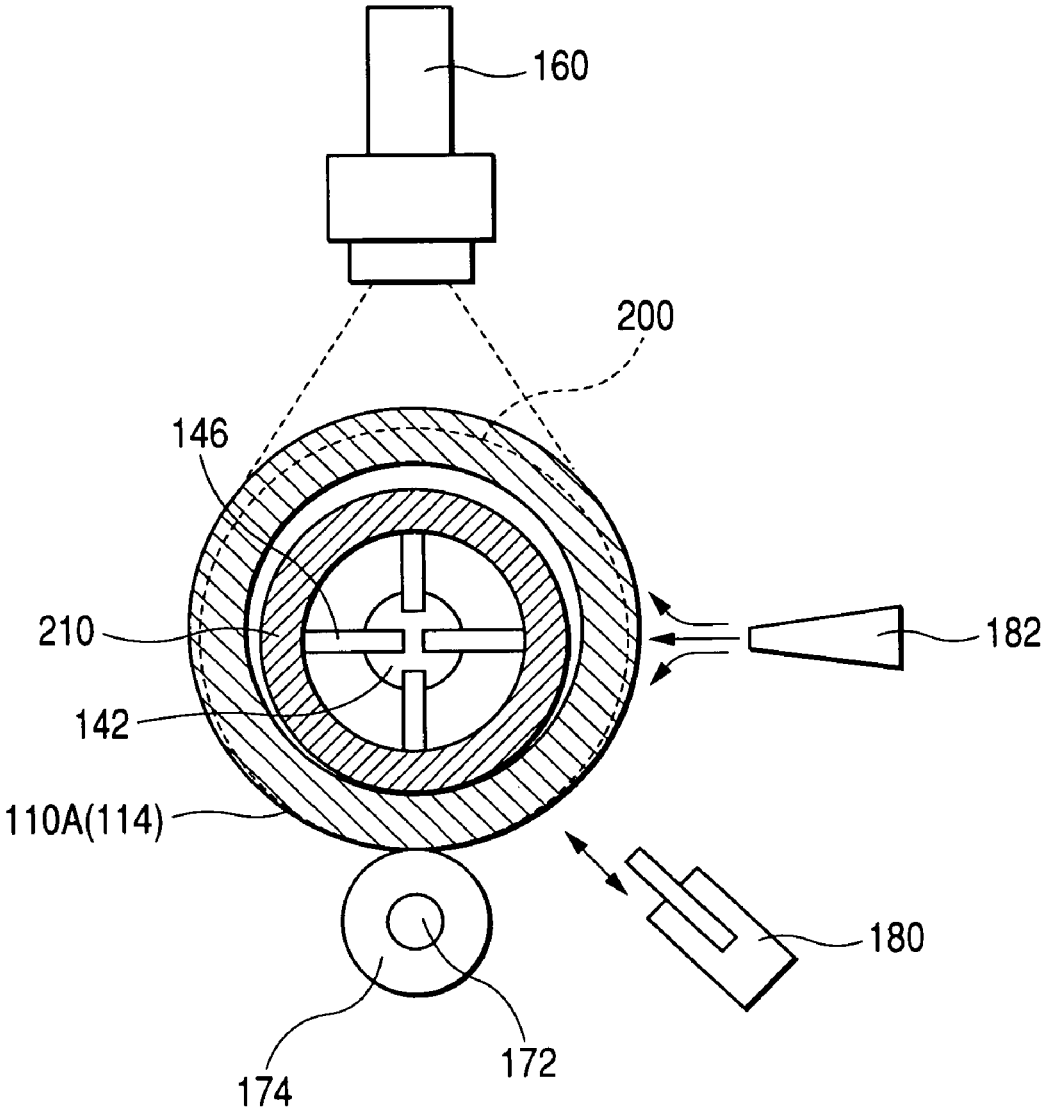
FIG. 4 is a view illustrating a modified form of a powder coating apparatus in which a scraping mechanism and a cleaning nozzle are provided.

Moreover, although the second embodiment has been described in connection with a structure where merely rotating the masking caps 110A, 120A allows a length of time required for cleaning to be shortened, the powder coating apparatus may further include either a scraping mechanism 180 or a cleaning nozzle 182, both serving as powder resin removing mechanisms for intermittently or continuously removing adhered resin powder 190 from the masking caps 110A, 120A, which are mounted on the masking caps 110A, 120A (on one side or on both sides thereof) at positions in the vicinity thereof as shown in FIG. 4.

A whole of or part of the scraping mechanism 180 may be so arranged as to be moveable toward an operative position in substantial contact with the masking caps 110A, 120A and retractable away from the operative position. During cleaning process, the scraping mechanism 180 is held in substantial contact with the outer peripheries of the masking caps 110A, 120A, which are in turn rotated. This enables adhered resin powder to be removed from the outer peripheries of the masking caps 110A, 120A. Also, the cleaning nozzle 182 may have a structure to enable compressed air to be supplied toward the outer peripheries of the masking caps 110A, 120A for blowing adhered resin powder 190 out of the outer peripheries of the masking caps 110A, 120A during cleaning operation.

Additionally, while the first embodiment has been set forth above with reference to a structure wherein the central position of the masking cap 110 is displaced from the central axis of the stator 200 to be eccentric toward the powder spray nozzle 160 with minimized airflow resistance of the clearance between the axial end faces of the stator 200 and the masking cap 110 in the area closer to the powder spray nozzle 160, the clearance associated with the area closer to the powder spray nozzle 160 may be determined to be wider than the clearance in the other area remote from the powder spray nozzle 160 to provide minimized airflow resistance in the clearance at the area closer to the powder spray nozzle 160 with the use of or without the use of the eccentric layout.

While the specific embodiment of the present invention has been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention, which is to be given the full breadth of the following claims and all equivalents thereof.

What is claimed is:

1. A powder coating apparatus comprising:

a rotating and holding mechanism for rotatably holding a cylindrical object having an outer circumferential periphery serving as a coating area, non-coating areas axially extending from axial end faces of the cylindrical object, respectively, and an inner space formed inside the outer circumferential periphery;

a powder spray nozzle for spraying a resin powder onto the outer circumferential periphery of the cylindrical object;

first and second masking members disposed on both axial ends of the cylindrical object for rotatably supporting the cylindrical object to mask the non-coating areas of the cylindrical object so as to define axial clearances between the first and second masking members and the axial end faces of the cylindrical object, respectively, and first and second radial clearances formed on both ends of the cylindrical object between the first and second masking members and the both ends of the cylindrical object, respectively; and a compressed air supply unit connected through one of the first and second masking members to the inner space of the cylindrical object for supplying a flow of compressed air thereto to discharge the flow of compressed air from the inner space of the cylindrical object to an outside of the cylindrical object through the first and second axial clearances and the first and second radial clearances in opposition to a flow of the resin powder being sprayed onto the outer circumferential periphery of the cylindrical object.

2. The powder coating apparatus according to claim 1, wherein:

the rotating and holding mechanism includes drive means, and a rotary shaft driven with the drive means and extending through the other one of the first and second masking members toward the inner space of the cylindrical object to rotatably drive the same while maintaining the first and second axial clearances and the first and second radial clearances;

the one of the first and second masking members has a through bore communicating with the compressed air supply unit to admit a flow of the compressed air to the inner space of the cylindrical body;

the cylindrical object is axially spaced from the first and second masking members to provide axial spaces, respectively, to direct the flow of the compressed air to the radial clearances and the axial clearances; and the first radial clearances have less flow clearances than those of the second radial resistances to direct the flow of the compressed air to the first and second axial clearances in opposition to the flow of resin powder.

3. The powder coating apparatus according to claim 2, wherein the first and second masking members have a rotation symmetric profile; and wherein a central axis of the first and second masking members is displaced from a central axis of the object to be coated to be eccentric toward the powder spray nozzle.

4. The powder coating apparatus according to claim 1, wherein the first radial clearances include a gap greater than that of the second radial clearances.

5. The powder coating apparatus according to claim 1, further comprising:

a mask member rotating mechanism for rotating the first and second masking members.

6. The powder coating apparatus according to claim 1, further comprising:

a powder resin removing mechanism for removing the powder resin from the mask member.

* * * * *